US008327479B2

(12) United States Patent
Wurdeman

(10) Patent No.: US 8,327,479 B2
(45) Date of Patent: Dec. 11, 2012

(54) STEERING MECHANISMS FOR HOSPITAL BEDS

(75) Inventor: Byron Wade Wurdeman, Elkin, NC (US)

(73) Assignee: Piedmont Global Solutions, Inc., Oak Ridge, NC (US)

( * ) Notice: Subject to any disclaimer, the term of this patent is extended or adjusted under 35 U.S.C. 154(b) by 0 days.

(21) Appl. No.: 13/309,914

(22) Filed: Dec. 2, 2011

(65) Prior Publication Data

US 2012/0090093 A1 Apr. 19, 2012

Related U.S. Application Data

(62) Division of application No. 12/850,144, filed on Aug. 4, 2010, now Pat. No. 8,091,162, and a division of application No. 11/398,098, filed on Apr. 5, 2006, now Pat. No. 7,788,748.

(60) Provisional application No. 60/668,859, filed on Apr. 6, 2005.

(51) Int. Cl.
*A61G 7/00* (2006.01)

(52) U.S. Cl. ..... 5/600; 5/618; 5/81.1 R

(58) Field of Classification Search ..... 5/424–430, 5/618, 611; 74/492; 280/43, 43.1; 180/19.1
See application file for complete search history.

(56) References Cited

U.S. PATENT DOCUMENTS 1,059,515 A 4/1913 Barr
1,118,931 A 12/1914 Hasley
2,722,017 A 11/1955 Burst et al.
2,876,654 A * 3/1959 Sweitzer ..... 74/493
3,021,534 A 2/1962 Hausted
3,053,568 A 9/1962 Miller et al.
3,063,066 A 11/1962 Peck et al.
3,112,500 A 12/1963 MacDonald
3,239,853 A 3/1966 MacDonald
3,304,116 A 2/1967 Stryker
3,428,307 A 2/1969 Kennedy et al.
3,503,082 A 3/1970 Kerwit
3,526,008 A 9/1970 Pruim
4,038,709 A 8/1977 Kerwit
4,084,274 A 4/1978 Willis et al.
4,183,109 A 1/1980 Howell
4,186,456 A 2/1980 Huempfner
4,439,880 A 4/1984 Koncelik et al.
4,453,766 A 6/1984 DiVito
4,489,449 A 12/1984 Failor et al.
4,592,104 A 6/1986 Foster et al.
4,771,492 A 9/1988 Paine et al.
4,847,929 A 7/1989 Pupovic
4,862,529 A 9/1989 Peck
4,926,457 A 5/1990 Poehner et al.
5,014,391 A 5/1991 Schulte (Continued)

OTHER PUBLICATIONS http://www.hill-rom.com/usa/TotalCare.htm, *The TotalCare®*, 13 pages, 2006©.

(Continued)

*Primary Examiner* — Fredrick Conley
(74) *Attorney, Agent, or Firm* — Myers Bigel Sibley & Sajovec, P.A.

(57) ABSTRACT

A vehicle for use in hospitals, and the like, giving better mobility, steering, braking and passenger handling while providing comfort to the passengers from the time they lay down until they are standing on the side through the rotation and tilting ability of the frame.

20 Claims, 11 Drawing Sheets

U.S. PATENT DOCUMENTS 5,072,463 A 12/1991 Willis
5,083,625 A * 1/1992 Bleicher ..... 180/65.1
5,095,561 A 3/1992 Green et al.
5,230,113 A 7/1993 Foster et al.
5,348,326 A 9/1994 Fullenkamp et al.
5,418,988 A 5/1995 Iura
5,425,151 A 6/1995 Iura
5,444,883 A 8/1995 Iura
5,479,666 A 1/1996 Foster et al.
5,497,518 A 3/1996 Iura
5,507,050 A 4/1996 Welner
5,613,254 A 3/1997 Clayman et al.
5,680,661 A 10/1997 Foster et al.
5,682,631 A 11/1997 Weismiller et al.
5,692,256 A 12/1997 Kramer
5,715,548 A 2/1998 Weismiller et al.
5,724,685 A 3/1998 Weismiller et al.
5,732,423 A 3/1998 Weismiller et al.
5,745,937 A 5/1998 Weismiller et al.
5,771,511 A 6/1998 Kummer et al.
5,806,111 A 9/1998 Heimbrock et al.
5,906,016 A 5/1999 Ferrand et al.
5,940,910 A 8/1999 Weismiller et al.
5,987,671 A 11/1999 Heimbrock et al.
6,003,174 A 12/1999 Kantrowitz et al.
6,047,424 A 4/2000 Osborne et al.
6,058,531 A 5/2000 Carroll
6,178,575 B1 1/2001 Harada
6,182,310 B1 2/2001 Weismiller et al.
6,256,812 B1 7/2001 Bartow et al.
6,289,536 B1 9/2001 Betson
6,315,319 B1 11/2001 Hanson et al.
6,321,878 B1 11/2001 Mobley et al.
6,357,065 B1 3/2002 Adams
6,363,552 B1 4/2002 Hornbach et al.
6,421,854 B1 7/2002 Heimbrock
6,473,921 B2 11/2002 Brooke et al.
6,505,365 B1 1/2003 Hanson et al.
6,566,833 B2 5/2003 Bartlett et al.
6,584,629 B2 7/2003 Tsuji et al.
6,601,251 B2 8/2003 Paul
6,611,979 B2 9/2003 Welling
6,615,430 B2 9/2003 Heimbrock
6,640,360 B2 11/2003 Hornbach et al.
6,658,680 B2 12/2003 Osborne et al.
6,675,415 B2 1/2004 Wong
6,684,420 B2 2/2004 Koenig et al.
6,691,348 B2 2/2004 Plummer et al.
6,694,548 B2 2/2004 Foster et al.
6,694,549 B2 2/2004 Perez et al.
6,701,554 B2 3/2004 Heimbrock
6,708,358 B2 3/2004 Hensley
6,725,474 B2 4/2004 Foster et al.
6,725,956 B1 4/2004 Lemire
6,779,209 B2 8/2004 Ganance
6,826,793 B2 12/2004 Tekulve
6,880,186 B2 4/2005 Johansson
6,880,189 B2 4/2005 Welling et al.
6,886,196 B2 5/2005 Nygren et al.
6,893,386 B2 5/2005 Charoenchit
6,934,984 B2 8/2005 Marsden et al.
6,938,289 B2 9/2005 Morin
6,951,036 B2 10/2005 Lemire
6,957,461 B2 10/2005 Osborne et al.
6,978,501 B2 12/2005 Vrzalik
7,017,208 B2 3/2006 Weismiller et al.
7,024,708 B2 4/2006 Tomas et al.
7,028,354 B2 4/2006 Nygren et al.
7,062,805 B2 6/2006 Hopper et al.
7,073,220 B2 7/2006 Simmonds et al.
7,076,818 B2 7/2006 Kummer et al.
7,086,103 B2 8/2006 Barhelt
7,086,107 B2 8/2006 Ellis et al.
7,107,636 B2 9/2006 Metz et al.
7,171,708 B2 2/2007 Osborne et al.
7,191,482 B2 3/2007 Romano et al.
7,197,779 B2 4/2007 Shalikar
7,213,279 B2 5/2007 Weismiller et al.
7,216,378 B2 5/2007 Barth et al.
7,216,384 B2 5/2007 Allen et al.
7,222,377 B2 5/2007 Kramer et al.
7,234,178 B2 6/2007 Qi
7,237,287 B2 7/2007 Weismiller et al.
7,257,850 B1 8/2007 Tekulve
7,296,312 B2 11/2007 Menkedick et al.
7,302,722 B2 12/2007 Karmer, Jr. et al.
7,343,916 B2 3/2008 Biondo et al.
7,373,677 B2 5/2008 Barthelt
7,395,568 B2 7/2008 Damewood
7,406,731 B2 8/2008 Menkedick et al.
7,443,302 B2 10/2008 Reeder et al.
7,454,805 B2 11/2008 Osborne et al.
7,472,439 B2 1/2009 Lamire et al.
7,676,862 B2 3/2010 Poulos et al.
2004/0064886 A1 4/2004 Alverson et al.
2004/0158923 A1 8/2004 Perez et al.
2006/0059621 A1 3/2006 Poulos et al.
2006/0090261 A1 5/2006 Vrzalik
2006/0150329 A1 7/2006 Nygren et al.
2006/0179571 A1 8/2006 Newkirk
2006/0195984 A1 9/2006 HakamiuN et al.
2007/0000058 A1 1/2007 Brown et al.
2007/0000059 A1 1/2007 Brown et al.
2007/0151027 A1 7/2007 Hensley et al.
2007/0294828 A1 12/2007 Hornbach et al.

OTHER PUBLICATIONS

Brochure, The Hill-Rom difference, *TotalCare® System*, 12 pages, Sep. 7, 2005.
Service Manual, TotalCare® Bed System From Hill-Rom, Nov. 1997, Manual Front Page and pp. i-xx of 640 pages.
Service manual, VersaCare® Bed From Hill-Rom, Feb. 2004m Manual Front Page and pp. i-xvi of 367 pages.

* cited by examiner

TWIN SCISSOR LIFT MECHANISM

FOUR WAY EQUAL PLATFORM TILTING MECHANISM 2

Arm Rail Mechanism

Comfort Side Standing
Egress Mechanism

STEERING MECHANISMS FOR HOSPITAL BEDS

RELATED APPLICATIONS

This application is a second divisional of U.S. patent application Ser. No. 11/398,098, filed Apr. 5, 2006, which issued as U.S. Pat. No. 7,788,748 on Sep. 7, 2010, which claims priority to U.S. Provisional Application Ser. No. 60/668,859, filed Apr. 6, 2005, through first divisional U.S. patent application Ser. No. 12/850,144, filed Aug. 4, 2010, now U.S. Pat. No. 8,091,162 the contents of which are hereby incorporated by reference as if recited in full herein.

FIELD OF THE INVENTION

The present invention relates to beds for use in hospitals, nursing homes or residential homes.

SUMMARY OF EMBODIMENTS OF THE INVENTION

Embodiments of the present invention are directed to beds with rotating sleep surfaces that can be configured to sit into a chair and also may stand a patient up like a lift chair on the side of the bed.

The present invention includes 8" casters for specific ease of steering.

The present invention includes a braking system operated by hydraulics whereby the casters may be locked and released with one cylinder. Components of the braking system thereof are strategically located inside the bottom frame rails.

The present invention includes a steering system that is spring loaded to the floor and lifted with a hydraulic cylinder.

The present invention includes a twin scissor mechanism actuated by a cylinder with a cylinder extension so that the mechanism may operate at full extension in a confined space.

The present invention includes a rotating sleep surface mounted to the center frame at the top of the scissors allowing operating rotation of 360 degrees.

The present invention includes a mounted platform system attaching to the rotating sleep surface that allows the upper frame to tilt around the four-way platform at optimal degrees of tilt.

The present invention includes arm rails that are mounted to the main frame operated by pin or latch release to allow straight in and out movement. The rail is spring loaded and will automatically release when the pin or latch is activated. The up/down feature will stop at designated points along the back of the rack and is controlled by a rack and pinion guide system.

The present invention includes side egress chair capabilities allowing the entire sleep surface to rotate 360 degrees left or right of center and can transition to a seated position at 90 degrees left or right of center. This side egress chair position is locked at 90 degrees, 180 degrees and 270 degrees.

The present invention includes side egress lift chair allowing the patient to transition from a suspended comfort position to a chair position to a gentle walkout exit position. Walkout exits are obtainable at 90 degrees and 270 degrees.

The present invention allows 30 degree tilt which is easily achieved by main frame proximity to the floor when the scissors are raised to a predetermined height.

The present invention will be described hereafter with reference to the attached drawings that are given as non-limiting examples.

DETAILED DESCRIPTION OF EMBODIMENTS OF THE INVENTION

PCV Braking Mechanism

Figure 1:
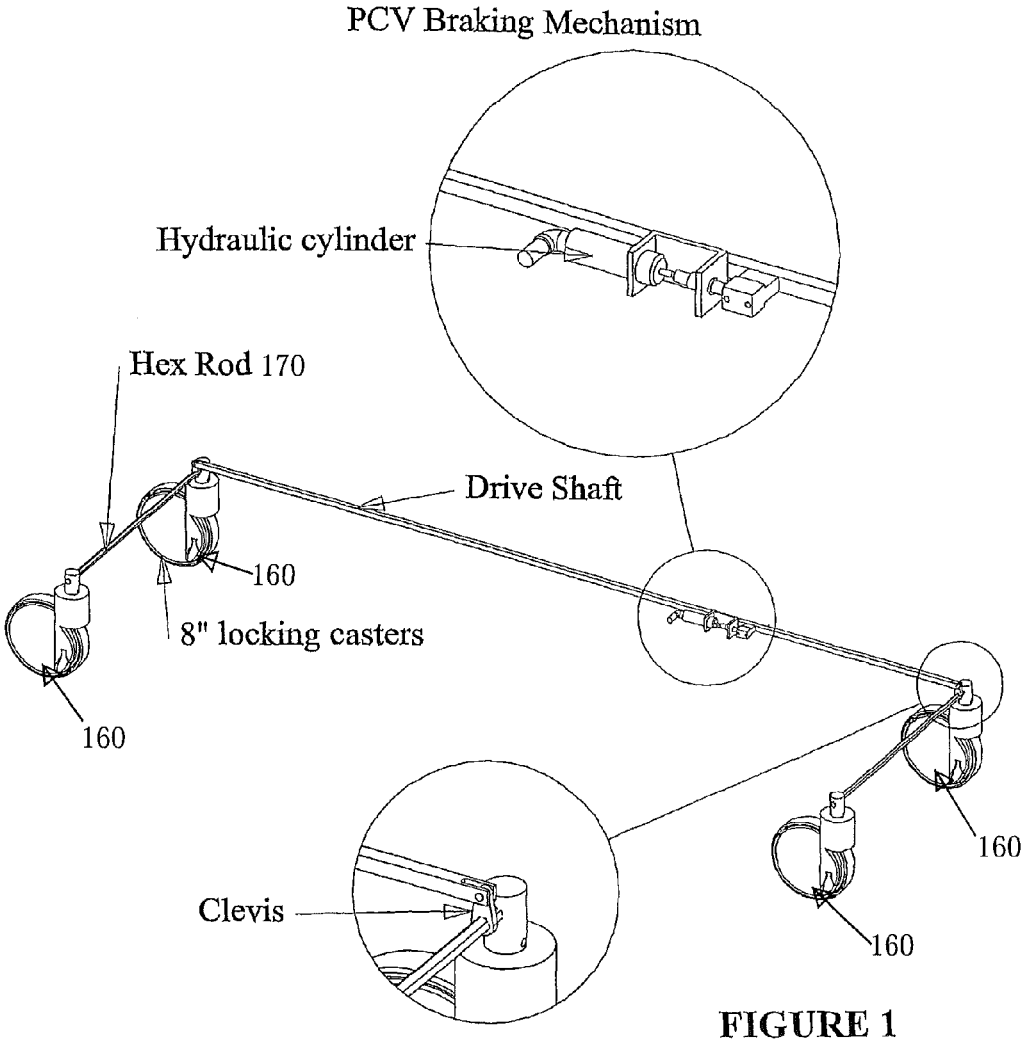
FIG. 1 is a perspective view of a PCV Braking Mechanism.

FIG. 1 illustrates the PCV Braking mechanism is made of 4 -8 inch locking casters, 2 -hex rods, 1 -drive shaft bar, 1 -hydraulic cylinder, 2 -clevis mounts.

The casters are mounted to the four corners of the bed into square tubes. The tubes are drilled to allow for set screws in each caster and to slide a full length hex rod through the head of the caster to lock the brakes. The hex rod is put through the short 1 by 3 inch frame tube on both ends of the bed. A clevis is mounted to one end of each of the hex rods. The drive shaft bar is mounted to the clevis on each end. The drive shaft bar runs through the long 1 by 3 tube. There is a slot cut into the side of the long tube to connect the hydraulic cylinder to the drive shaft bar. When activated the cylinder rocks the clevis, the clevis rotates the hex rod and locks or unlocks the brakes on all 4 of the casters.

PCV Steering Mechanism

Figure 2:
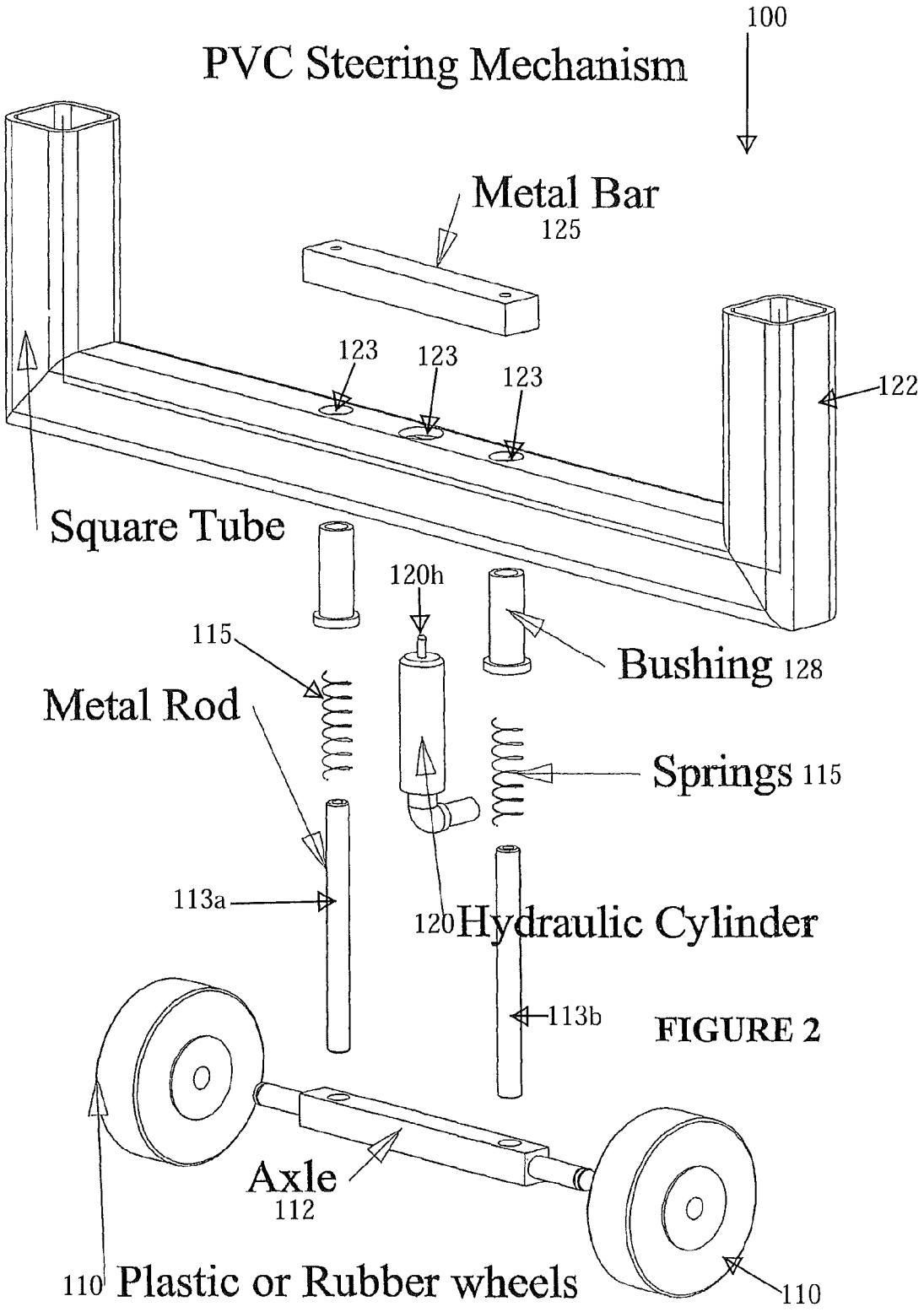
FIG. 2 is an exploded side perspective view of a PCV Steering Mechanism.

FIG. 2 illustrates the steering mechanism 100 is made of 2 plastic or rubber wheels 110, springs 115, hydraulic cylinder 120, metal rods 113*a*, 113*b* and square tubes 122.

The steering mechanism 100 is mounted to the frame 150 with 3 metal square tubes 122 that are welded to the main base frame 150. There are holes 123 in the cross section of tube 122 to mount the spring loaded rods 113*a*, 113*b* to and put the threaded hydraulic cylinder 125 through. The spring loaded rods are attached to the bar the casters 160 (FIGS. 1, 8) are mounted to so the springs keep them on the floor. There is a bar 125 that connects above the square tube 122 to the spring loaded bars to make sure they stay straight up and down. It is the same bar that the hydraulic head 120*h* pushes on to lift the casters 160 (FIGS. 1, 8 and 10) off of the ground. This keeps the casters 160 on the floor until the bed needs to be moved side to side when the cylinder will raise them. This mechanism allowed us to push the bed 60 feet in a straight line by itself.

Drawing Legend

Figure 3A:
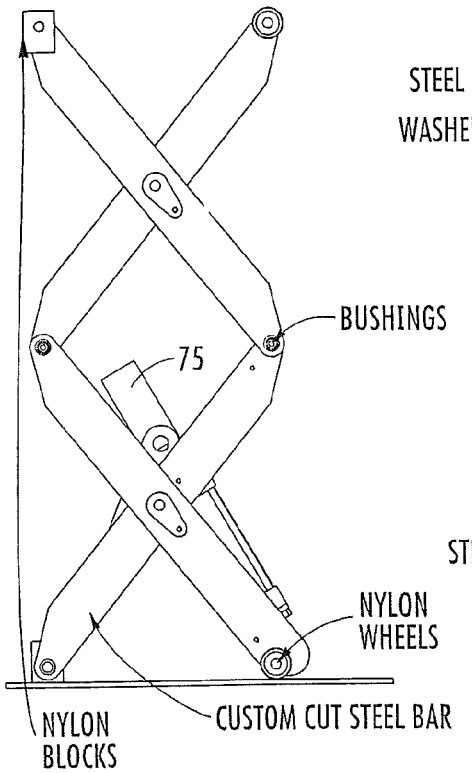
FIG. 3A is a side view of a Twin Scissor Lift Mechanism in an extended lift configuration.
Figure 3B:
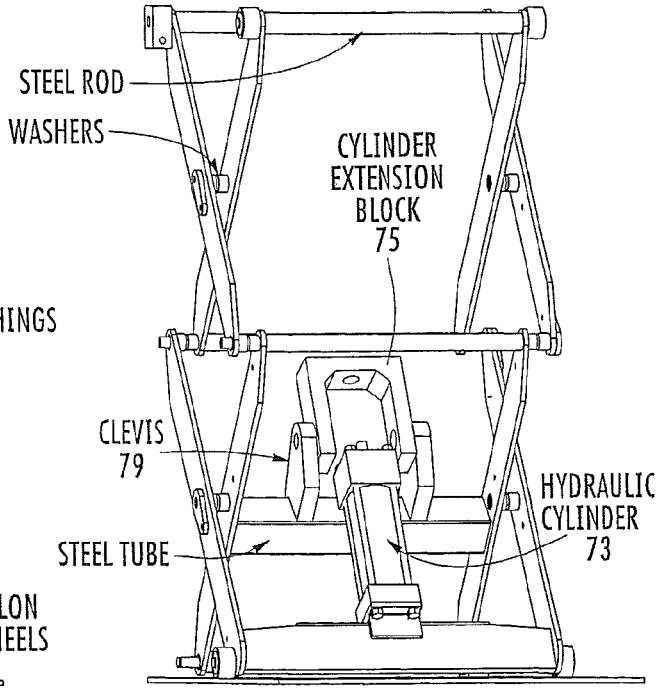
FIG. 3B is an end perspective view of the Twin Scissor Lift Mechanism shown in FIG. 3A.
Figure 3C:
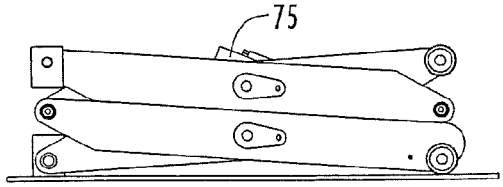
FIG. 3C is a side view of the device shown in FIG. 3A, illustrated in a collapsed configuration.

125 Metal Bar
122 Square Tube
123 Apertures
128 Bushing
115 Spring
113*a,* 113*b* Metal Rod
120 Hydraulic Cylinder
112 Axle
110 Wheels Twin Scissor Lift Mechanism FIGS. 3A-3C illustrate the twin scissor mechanism is made of custom cut steel bars, steel rods, steel tube, copper or nylon bushings, copper or nylon washers, cylinder extension block 75, nylon blocks and wheels, and can be driven by hydraulics cylinders, air cylinders, air bags, or several electric mechanisms. We chose the hydraulic cylinder because of load we want to lift. We plan to build less expensive models with the other mechanisms in the future.

The scissor mechanism has 8 scissor arms mounted with welds and washers between them to 6 cross structural support rods, 1 cross structural support bar and 1 cross structural support tube. The cross structural support tube has 2 clevis arms 79 welded to it and a custom designed cylinder extension 75 mounted to clevis arms 79 with bushing and washers so the extension 75 will pivot. The bottom of the cylinder is mounted with a screw to the top of the cross structural support bar and the top of the cylinder is attached with threads to the inside of the cylinder extension block 75. This allows a larger cylinder to fit in a smaller space and get full range of motion. The top of the scissor is mounted to the bottom of the main lift surface (50, FIG. 4) and to the top of the metal scissor housing that has a metal mounting bracket that is welded to both the main lift surface and the top of the scissor housing. Inside the metal mounting brackets are nylon blocks with holes in them to lock the cross structural support rods in place and allow them to move very quietly straight up and down on one end of the scissor. The other ends are attached with channel iron. The channel iron is welded to the top of the scissor housing on both sides and the bottom of the main lift surface. The channels act as tracks for the nylon wheels to run in. The wheels move from one end (our foot end) to the other end (our head end) causing the scissors to lift. The purpose of using the scissor is to get very low and very high while having an almost square top to work around to achieve degree of tilt on all 4 sides.

Rotating Surface Mechanism

Figure 4:
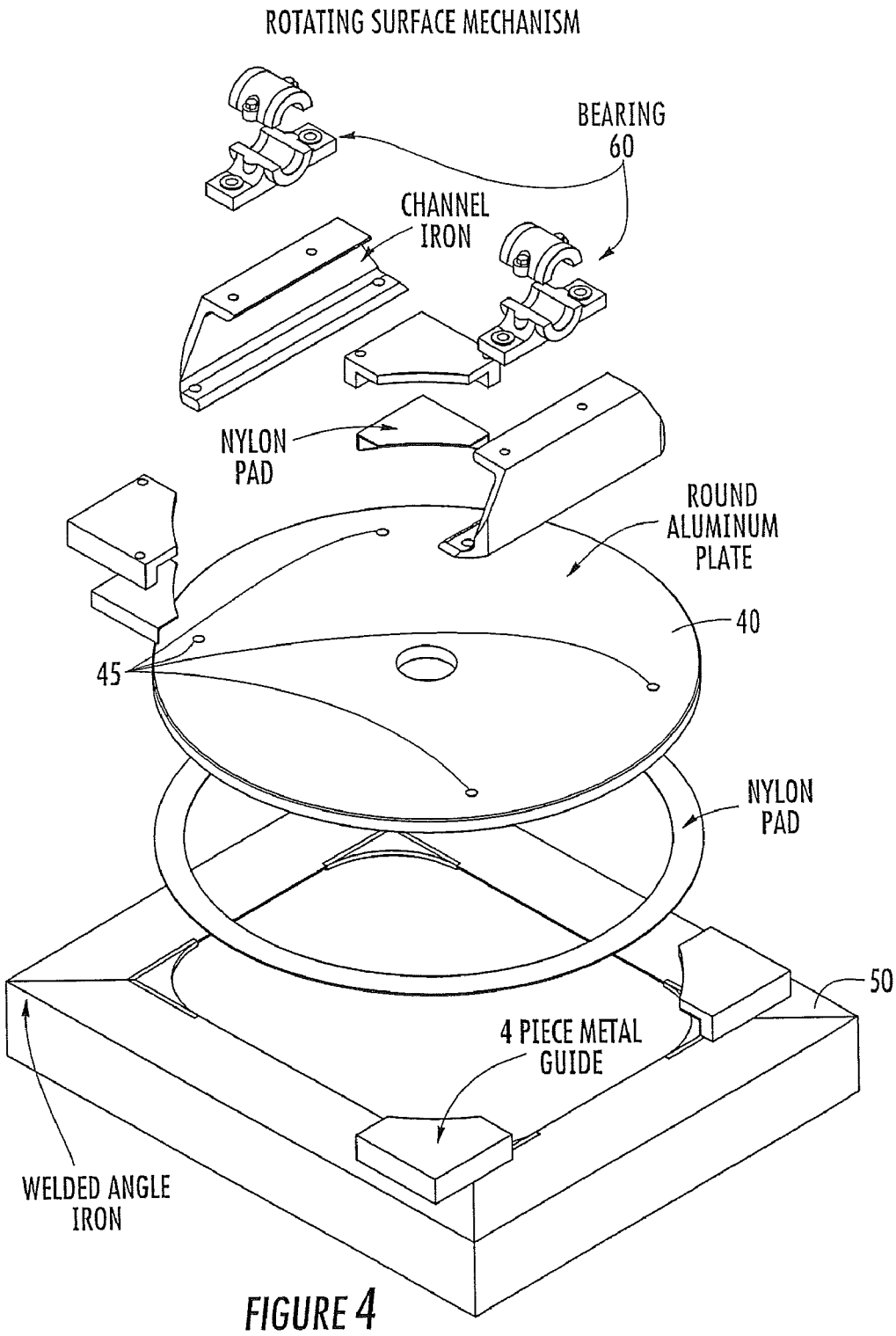
FIG. 4 is an exploded view of a Rotating Surface Mechanism.

FIG. 4 illustrates the rotating surface is made of steel angle iron, custom cut 4 piece metal guide, aluminum round plate, aluminum and steel channel, bearings, nuts, bolts, nylon pads.

The main lift surface 50 is made of 4 pieces of angle iron cut on a 45 degree angle and welded together to form four 90 degree angles. This makes the main frame 50 where everything else is attached. The flat side of the frame is on top and the wall side is faced down to the bottom. There are 2 channel tracks mounted with a weld to the bottom of the frame for the 2 scissor lift wheels to run in and 2 brackets welded to the bottom on the opposite side to make the scissor track straight up and down. The top of the surface has a custom cut round aluminum plate 40 mounted to the center. The mounts are made of steel and nylon. The bottom steel mounting brackets are welded to the frame to lock them in place and keep the round plate from moving. There are 4 custom cut nylon pieces that fit on the top and bottom of the round plate 40 inside of metal mounts for the round plate to ride on. There are 4 top metal pieces of the mount that screw into the frame top to lock the metal and nylon in place. These mounts cause the round plate 40 to make a smooth 360 degree movement. The top of the round plate has 2 pieces of channel custom cut and screwed to it to mount 2 bearings 60 and allow the sleep surface to tilt. The bearings are screwed to the top of the channel to mount the main support rod (20, FIG. 6, FIG. 10) for the sleep surface. As shown, the plate 40 includes circumferentially spaced apart apertures 45.

Four Way Equal Platform Tilting Mechanism

Figure 5A:
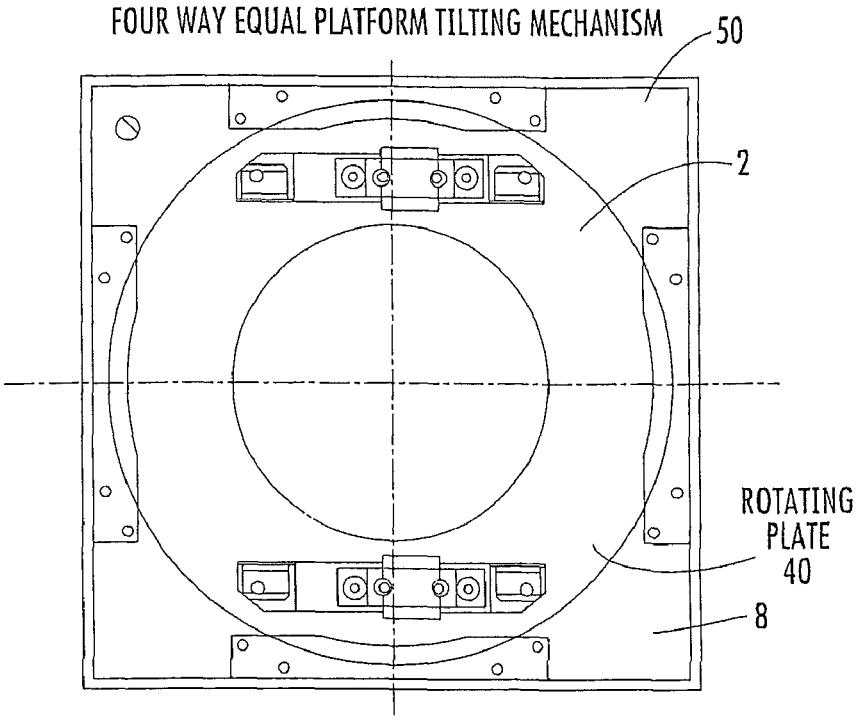
FIG. 5A is a top view of a Four Way Equal Platform Tilting Mechanism shown in FIG. 4.
Figure 5B:
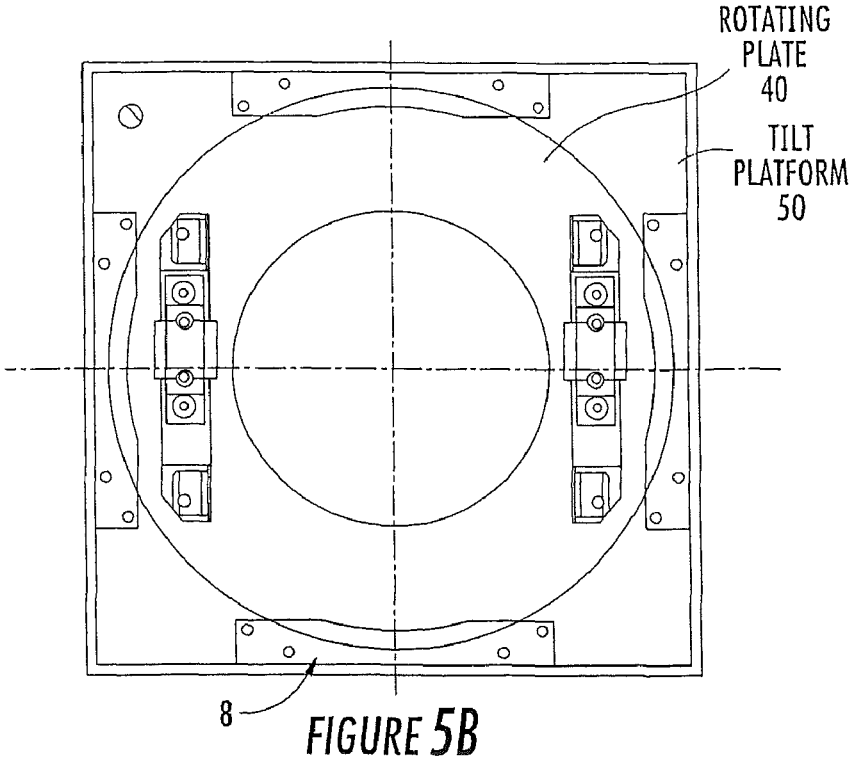
FIG. 5B is a rotated view of the Four Way Equal Platform Tilting Mechanism shown in FIG. 5A (rotated 90 degrees).
Figure 6:
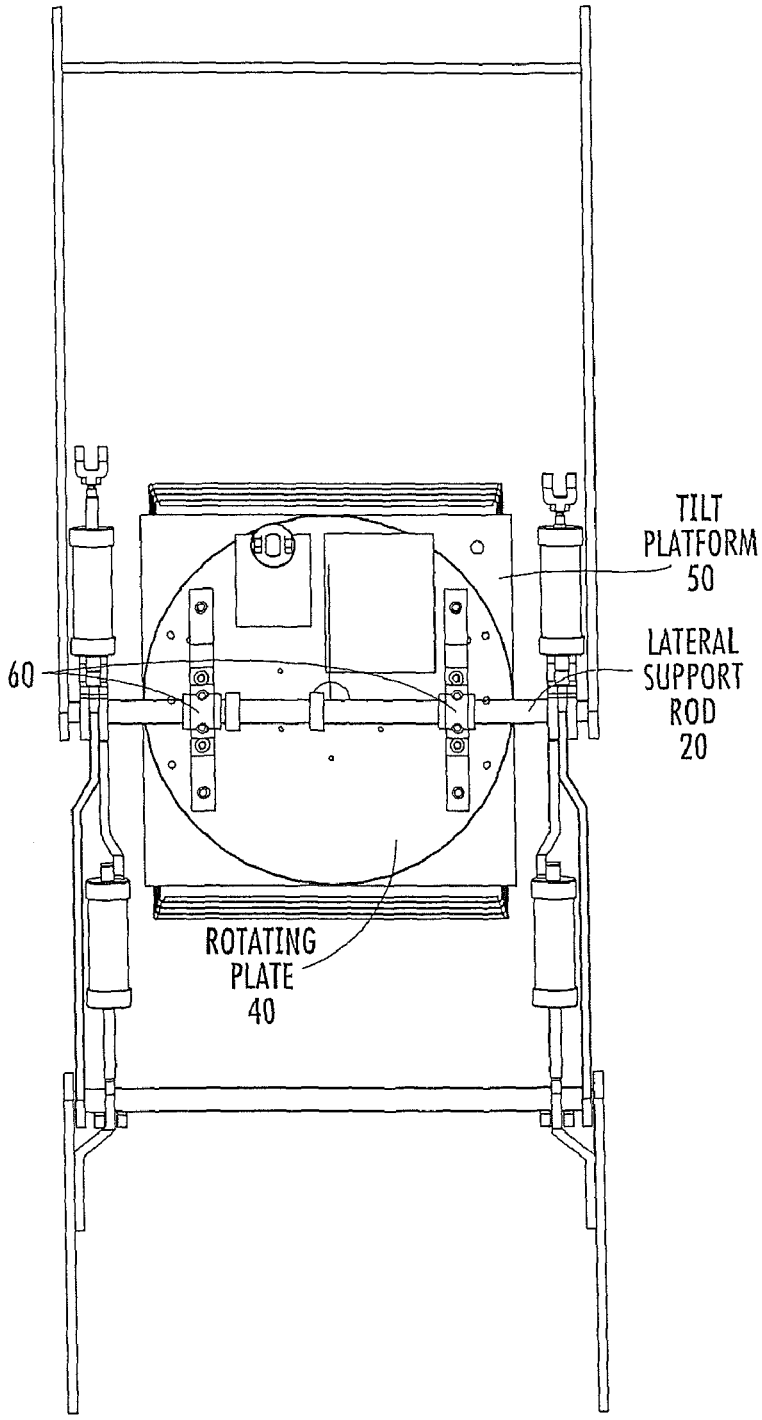
FIG. 6 is a top view of the Four Way Equal Platform Tilting Mechanism shown in FIGS. 5A and 5B shown attached to a sleep surface frame.

FIGS. 5A, 5B and 6 illustrate the Four Way Equal Platform Tilting Mechanism. The way the "Rotating Surface Frame" connects to the "Sleep Surface Frame" and the width of each allows the "Sleep Surface Frame" to fit over or around the "Rotating Surface Frame" on all sides. The "Rotating Surface Frame" has a triangle shaped main structural tilt bar mount that allows the back of the seat section or "Trend Section" to stay at an optimal degree of tilt while the front of that section fits over the "Rotating Surface Frame". FIG. 6 illustrates the primary support rod 20 attached to bearings 60 above the tilt platform 50 under the back and seat sections 15, 16, respectively, of the patient support surface.

Arm Rail Mechanism

Figure 7A:
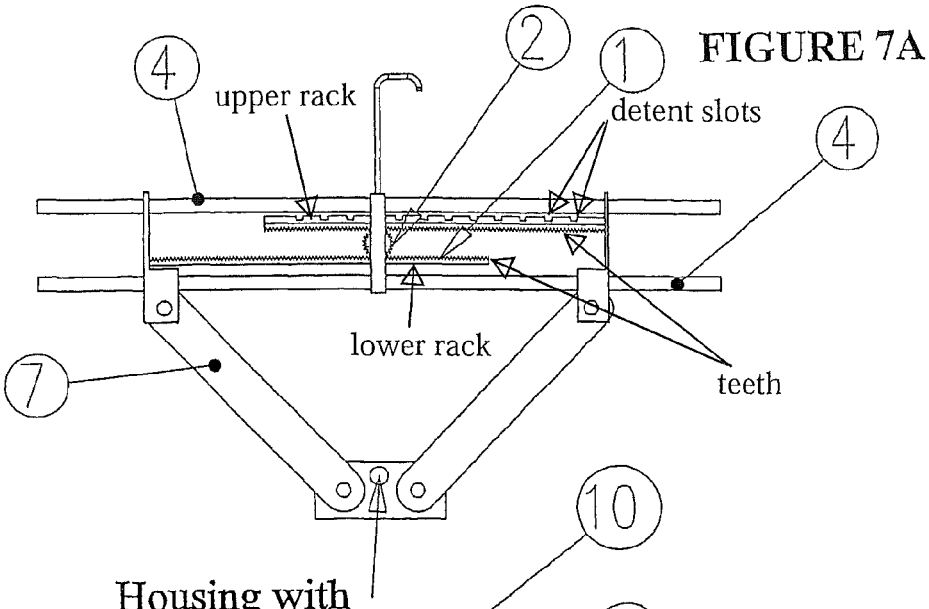
FIG. 7A is a side view of an Arm Rail Mechanism.
Figure 7B:
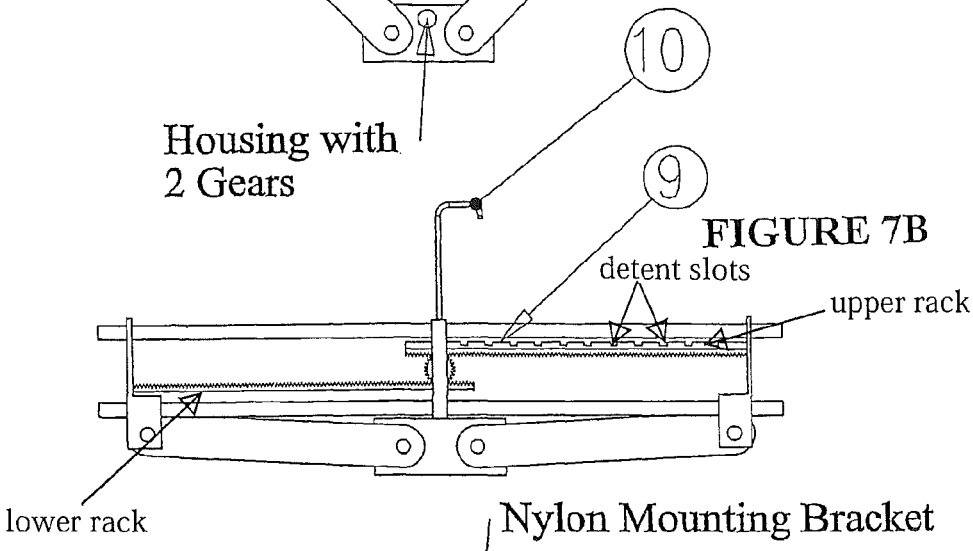
FIG. 7B is a side view of the device shown in FIG. 7A, illustrating the arm rail at first retracted position.
Figure 7C:
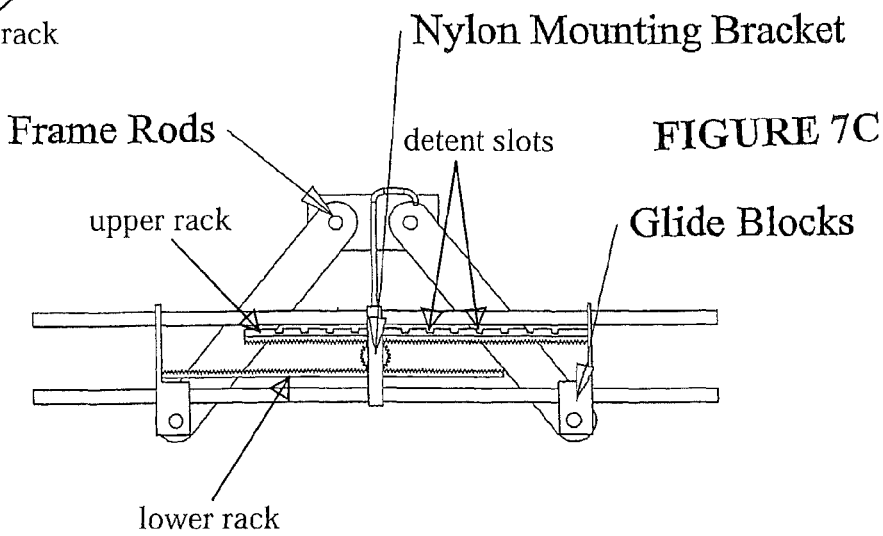
FIG. 7C is a side view of the device shown in FIG. 7A, illustrating the arm rail at a second retracted position below the position shown in FIG. 7B.

FIGS. 7A-7C illustrate the arm rail mechanism. The arm rails are made of steel, nylon, plastic gears, copper or nylon bushings, steel rods, custom cut metal blocks, snap rings, washers, rack and pinion, screws, springs, 1 latch or detent for the up-down feature and 1 latch or detent to release the rail from under the sleep surface.

The 2 frame rods are mounted through 2 holes in the sleep surface frame. The housing made of custom bent steel is mounted with screws or welded on the inside of the rail with 2 holes to house the gears and be the second guide for the 2 frame rods with bushings or washers on both sides. The frame rods are keyed to make the gears stay with the frame rods and spring loaded to push them out when they are released with the latch or manually pulled out. The custom made steel swing arms that move the rails low to high are welded to the frame rods on the outside of the bed. The glide mount rods are welded to the swing arms where there is a bushing inserted over the glide rods. The custom made glide blocks are mounted on top of the bushings with a washer on the inside and held on by snap rings on the outside. There are 2 holes in the glide blocks to mount the 2 glide slide rods though. A rack rod is mounted with the teeth facing up to the right guide block and a rack rod is mounted with the teeth facing down to the left guide block. The pinion gear is mounted in the center of the slide rods with the racks keyed into it to make sure the glide blocks move evenly in and out which causes the arm rail to travel straight up and down. The pinion is held in the center of the glide rods by a nylon mounting bracket that is screwed to the glide rods. The latch that holds the rail in any position is mounted through the top of the nylon mounting bracket stops the rails motion by hitting detent slots in the top of the upper rack.

Figure 8:
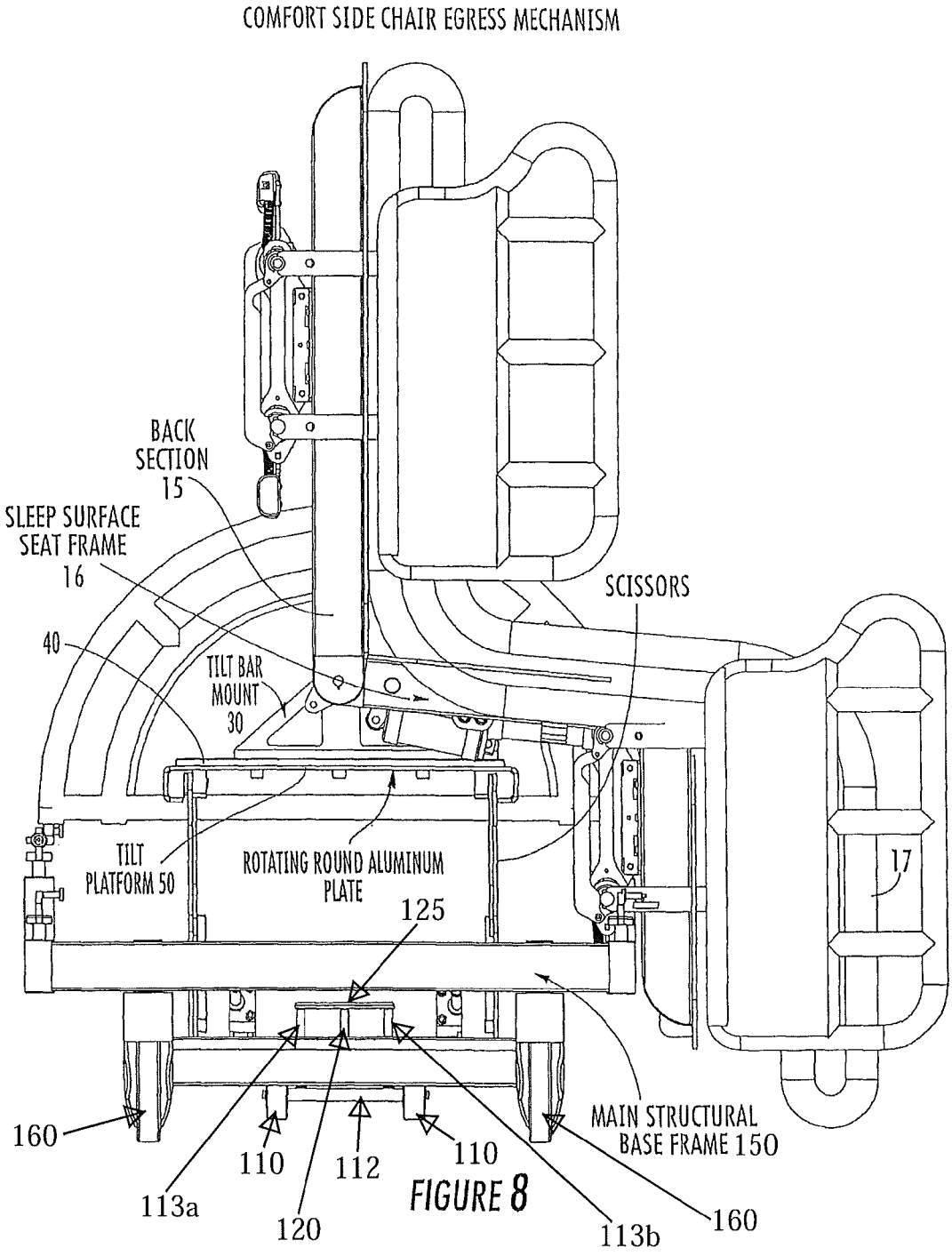
FIG. 8 is an end view (looking from the foot end) of a Comfort Side Chair Egress Mechanism.

Drawing Legend:

1. Rack
2. Pinion
4. Glide Slide Rods
7. Steel Swing Arms
9. Detent Bar
10. Release Latch Comfort Side Chair Egress Mechanism FIG. 8 illustrates the Comfort Side Chair Egress Mechanism. The comfort side chair egress is possible by attaching the Sleep Surface Seat Frame to the main structural tilt bar mount that sits on the rotating round aluminum plate 40. The main structural tilt bar mount 30 allows the Sleep Surface Seat Frame to be stopped in a flat position. When the sleep surface frame is rotated 90 degrees to either side of the main structural base frame, the scissors are raised high enough, the foot section 17 is 90 degrees vertically to main structural base frame and the seat 16 is flat or parallel to the main structural base frame, the bed can be manually positioned by the care giver into a chair perpendicular to the main structural base frame.

Comfort Side Standing Egress Mechanism

Figure 9:
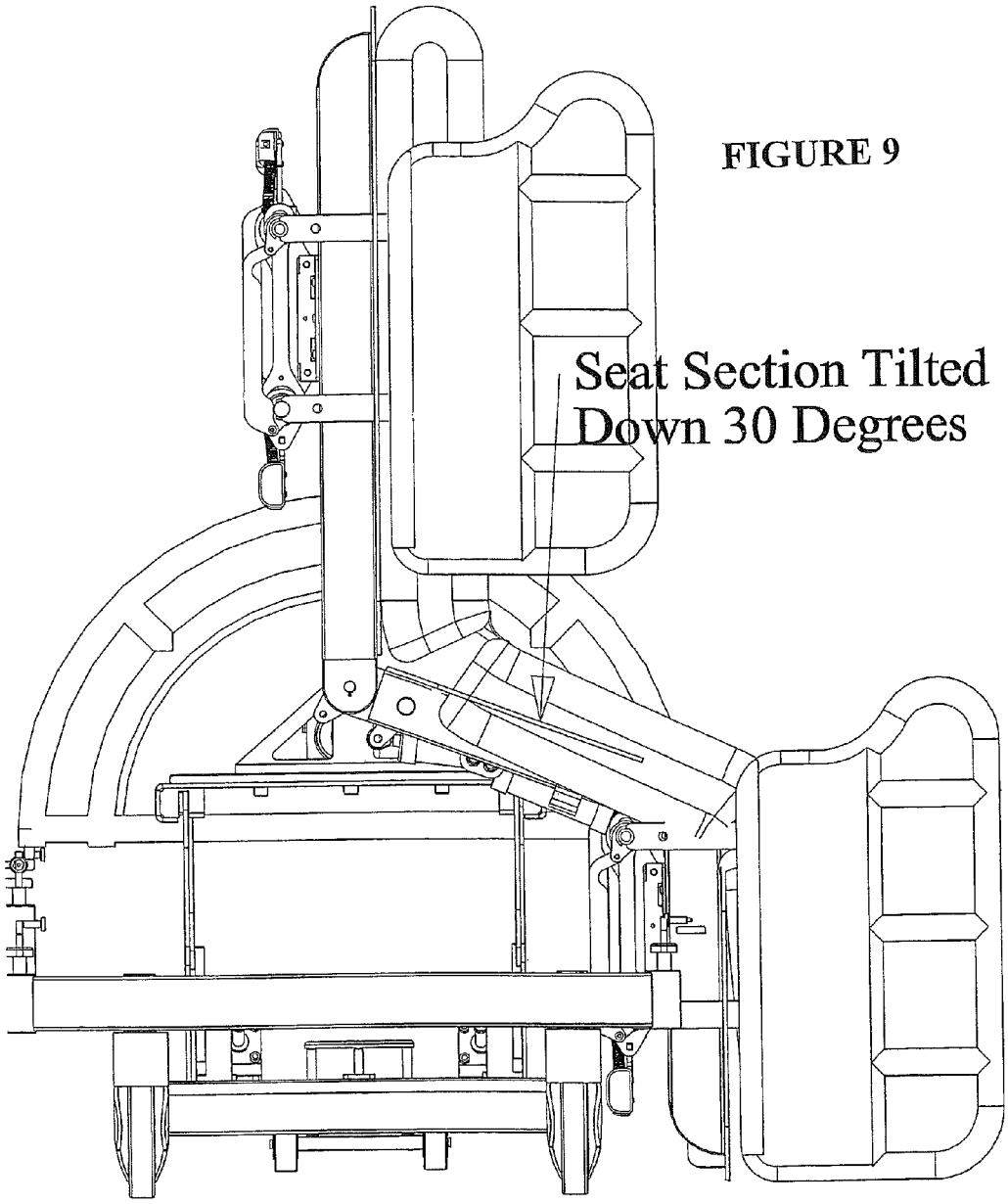
FIG. 9 is an end view (looking from the foot end) of the device shown in FIG. 8 with the bed translated into a Comfort Side Standing Egress configuration.

FIG. 9 illustrates the Comfort Side Standing Egress Mechanism. The comfort side standing egress is possible by attaching the Sleep Surface Seat Frame to the main structural tilt bar mount 30 that sits on the rotating round aluminum plate 40. The height of the main structural tilt bar mount allows the Sleep Surface Seat Frame to tilt 30 degrees down at the foot end. When the sleep surface frame is rotated 90 degrees to either side of the main structural base frame, the scissors are raised high enough, the foot section is kept perpendicular to the main structural base frame and a 30 degree tilt is applied to the seat, the bed will stand the patient up on the side of the bed.

PCV Tilt Mechanism

Figure 10:
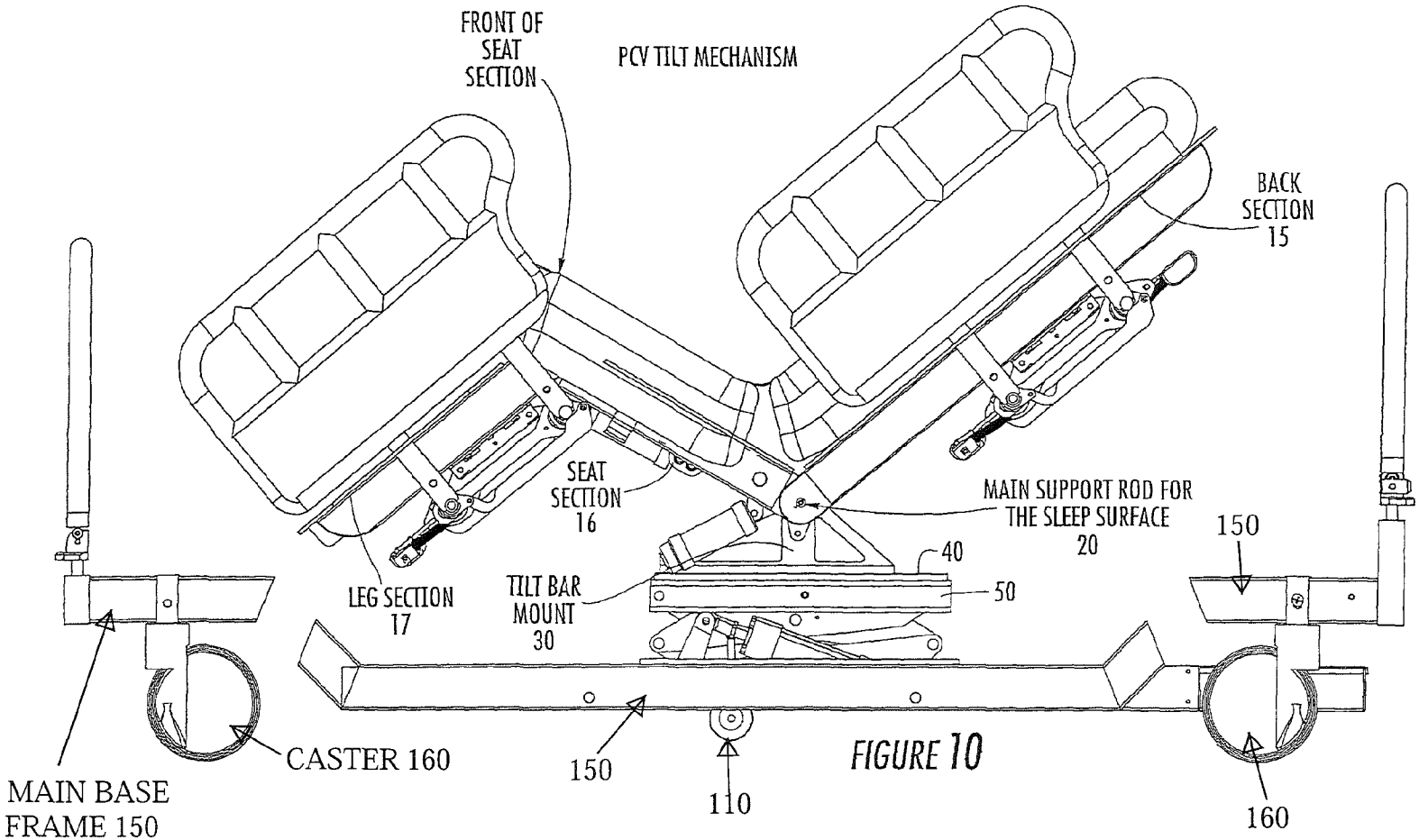
FIG. 10 is a side view of a PCV Tilt Mechanism.

FIG. 10 illustrates a PCV Tilt Mechanism. The triangle shaped main structural tilt bar mount 30 that allows the main support rod 20 for the sleep surface to stay high or lower than the foot section 17. If the main support rod 20 for the sleep surface remains higher than the front of the seat section 16 it allows for a 30 degree tilt forward. If it remains lower it allows for a 30 degree tilt backwards. The full range of motion is 60 degrees.

Manual Retracting and Extending Foot Section Mechanism

Figure 11:
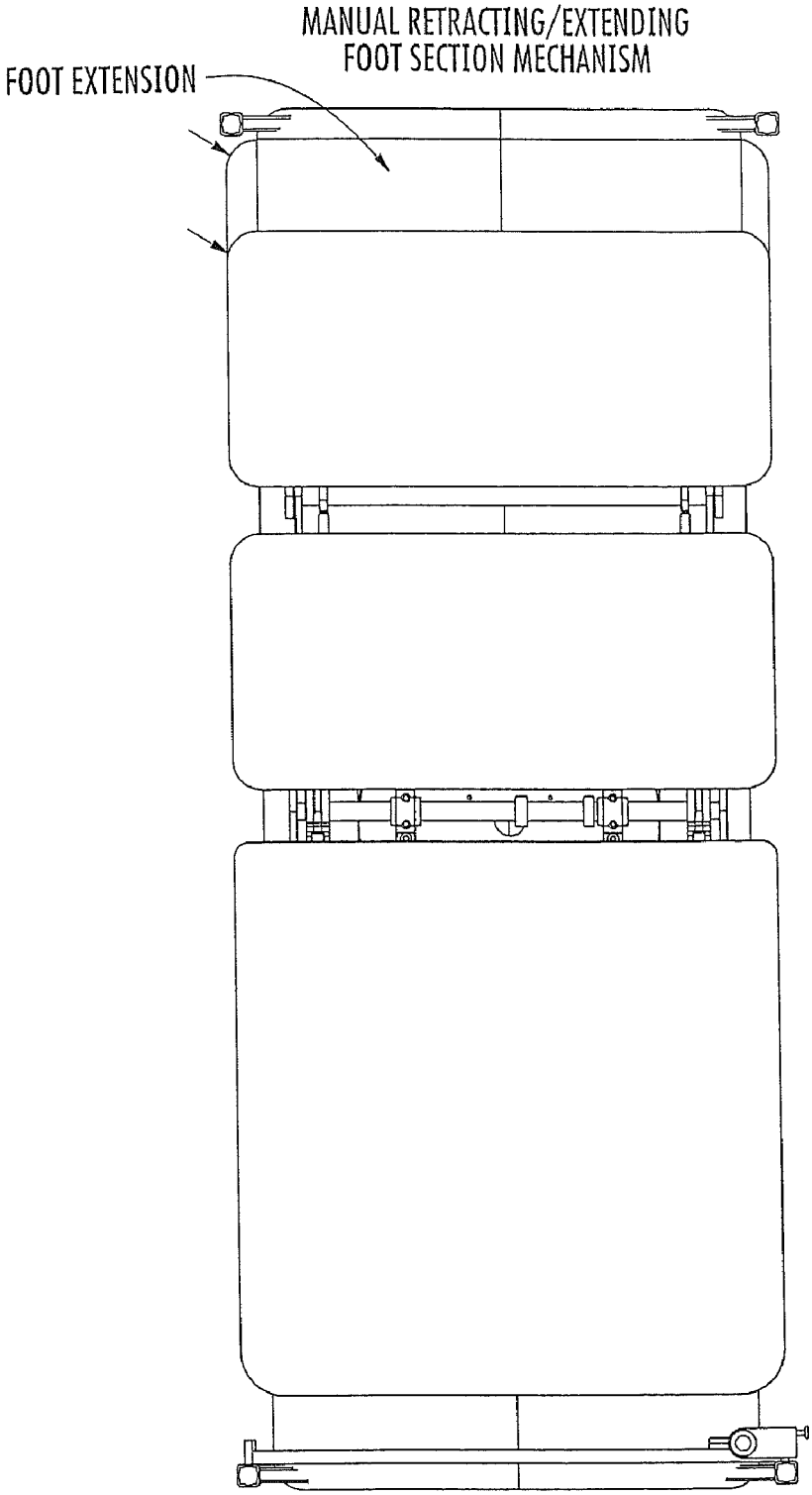
FIG. 11 is a top view of a sleep surface with a Manual Retracting/Extending Foot Section Mechanism.

FIG. 11 illustrates a sleep surface support with a Manual Retracting and Extending Foot Section Mechanism. The Manual Retracting and Extending Foot Section Mechanism located inside the "Sleep Surface Foot Frame" is made of one piece of channel iron welded to each side of the sleep surface foot frame to create a track to slide the extension in and out. There are manual stops going in and set pins on the outside to release it out. It is spring loaded to push out when the pin is released and will retract with pressure until it locks itself going in.

That which is claimed:

1. A hospital bed, comprising:

a base frame;

a plurality of casters, one each attached to a corner portion of the base frame; and a steering mechanism coupled to the base frame residing under a center portion of the hospital bed, the steering mechanism comprising:

an axle;

first and second spaced apart wheels attached to opposing end portions of the axle;

first and second upwardly extending and laterally spaced apart rods attached to opposing end portions of the axle, residing between the wheels;

a mounting member attached to the main base frame having first and second laterally spaced apart channels, the first channel sized to slidably receive the first rod therein and the second channel sized to slidably receive the second rod therein, wherein the first and second rods reside under the mounting member proximate the wheels; and a first spring in communication with the first rod and a second spring in communication with the second rod, wherein the first and second springs reside under the mounting member, between the axle and the mounting member and cooperate with the first and second rods to define spring-loaded rods, wherein the casters at the corner portions of the base frame are in communication with the spring-loaded first and second rods which keep the casters on a floor until they are raised.

2. The hospital bed of claim 1, wherein the mounting member has a length such that each opposing end is fixedly attached to a different long side of the base frame.

3. The hospital bed of claim 1, further comprising a hydraulic cylinder that is attached to the mounting member intermediate the first and second rods to lift the casters off the floor.

4. The hospital bed of claim 1, further comprising:

a first bushing having a receiving channel that slidably receives the first rod therein, the first bushing residing in the first channel of the mounting member; and a second bushing having a receiving channel that slidably receives the second rod therein, the second bushing residing in the second channel of the mounting member.

5. The hospital bed of claim 1, wherein the wheels have a smaller diameter than the casters.

6. The hospital bed of claim 5, wherein the casters are eight inch casters.

7. The hospital bed of claim 1, further comprising a lift mechanism and rotating sleep surface mechanism attached to the base frame.

8. The hospital bed of claim 7, further comprising an articulating sleep surface frame attached to the lift mechanism the and rotating sleep surface mechanism, and wherein the lift mechanism and the rotating sleep surface mechanism cooperate to convert the bed into a side-exit chair bed.

9. A hospital bed, comprising:

a base frame;

a plurality of casters, one each attached to a corner portion of the base frame; and a steering mechanism coupled to the base frame residing under a center portion of the hospital bed, the steering mechanism comprising:

an axle;

first and second spaced apart wheels attached to opposing end portions of the axle;

first and second upwardly extending and laterally spaced apart rods attached to opposing end portions of the axle, residing between the wheels;

a mounting member attached to the main base frame having first and second laterally spaced apart channels, the first channel sized to slidably receive the first rod therein and the second channel sized to slidably receive the second rod therein;

a first spring in communication with the first rod and a second spring in communication with the second rod, wherein the first and second springs reside under the mounting member, between the axle and the mounting member and cooperate with the first and second rods to define spring-loaded rods;

a first bushing having a receiving channel that slidably receives the first rod therein, the first bushing residing in the first channel of the mounting member;

a second bushing having a receiving channel that slidably receives the second rod therein, the second bushing residing in the second channel of the mounting member; and a bar that is attached to an upper surface of the mounting member and resides over the first and second channels.

10. The hospital bed of claim 9, wherein the mounting member comprises a square tube with upwardly extending opposing arms and a laterally extending center section, the center section having the laterally spaced apart channels.

11. A hospital bed, comprising:

a base frame;

a plurality of casters, one each attached to a corner portion of the base frame; and a steering mechanism coupled to the base frame residing under a center portion of the hospital bed, the steering mechanism comprising:

an axle;

first and second spaced apart wheels attached to opposing end portions of the axle first and second upwardly extending and laterally spaced apart rods attached to opposing end portions of the axle, residing between the wheels;

a mounting member attached to the main base frame having first and second laterally spaced apart channels, the first channel sized to slidably receive the first rod therein and the second channel sized to slidably receive the second rod therein; and a first spring in communication with the first rod and a second spring in communication with the second rod, wherein the first and second springs reside under the mounting member, between the axle and the mounting member and cooperate with the first and second rods to define spring-loaded rods, wherein the mounting member comprises a square tube with upwardly extending opposing arms and a laterally extending center section, the center section having the laterally spaced apart channels.

12. The hospital bed of claim 11, wherein the mounting member has a width that is greater than a width of the axle so that the arms of the mounting member reside outside an outer edge of an underlying wheel and extend upwardly above the axle.

13. The hospital bed of claim 11, wherein the mounting member is welded to the base frame.

14. A hospital bed, comprising:

a base frame;

four corner casters, one attached to each corner portion of the base frame; and a steering mechanism coupled to the main base frame residing under a center portion of the hospital bed, the steering mechanism comprising:

an axle having a first transverse length residing under a center portion of the hospital bed;

first and second spaced apart wheels attached to opposing end portions of the axle, wherein the wheels have a smaller diameter than a diameter of the casters;

first and second upwardly extending and laterally spaced apart rods attached to opposing end portions of the axle, residing between the wheels;

a mounting member attached to the main base frame having a second transverse length that is greater than the first transverse length of the axle, the mounting member having first and second laterally spaced apart channels, the first channel sized to slidably receive the first rod therein and the second channel sized to slidably receive the second rod therein; and a first spring in communication with the first rod and a second spring in communication with the second rod, the first and second springs residing between the mounting member and the axle and defining spring-loaded rods, wherein the mounting member is a square tube and has a third channel intermediate the first and second channels, the hospital bed further comprising a hydraulic actuator with an actuator head that extends through the third channel.

15. The hospital bed of claim 14, wherein the first and second wheels can be lifted with the hydraulic actuator.

16. A hospital bed, comprising:

a base frame;

four corner casters, one attached to each corner portion of the base frame; and a steering mechanism coupled to the main base frame residing under a center portion of the hospital bed, the steering mechanism comprising:

an axle having a first transverse length residing under a center portion of the hospital bed;

first and second spaced apart wheels attached to opposing end portions of the axle, wherein the wheels have a smaller diameter than a diameter of the casters;

first and second upwardly extending and laterally spaced apart rods attached to opposing end portions of the axle, residing between the wheels;

a mounting member attached to the main base frame having a second transverse length that is greater than the first transverse length of the axle and with opposing ends that statically attach to opposing long sides of the base frame, the mounting member having first and second laterally spaced apart channels, the first channel sized to slidably receive the first rod therein and the second channel sized to slidably receive the second rod therein; and a first spring in communication with the first rod and a second spring in communication with the second rod, the first and second springs residing between the mounting member and the axle and defining spring-loaded rods, wherein the first and second wheels are located under a mass of weight in a center of the bed, and wherein the four corner casters can be spring-loaded down against a floor using the spring loaded rods that reside under the mounting member.

17. A hospital bed, comprising:

a base frame;

a plurality of casters, one each attached to a corner portion of the base frame; and a steering mechanism coupled to the base frame residing under a center portion of the hospital bed, the steering mechanism comprising:

an axle;

first and second spaced apart wheels attached to opposing end portions of the axle;

first and second upwardly extending and laterally spaced apart rods attached to opposing end portions of the axle, residing between the wheels;

a mounting member attached to the main base frame having first and second laterally spaced apart channels, the first channel sized to slidably receive the first rod therein and the second channel sized to slidably receive the second rod therein; and a first spring in communication with the first rod and a second spring in communication with the second rod, wherein the first and second springs reside under the mounting member, between the axle and the mounting member and cooperate with the first and second rods to define spring-loaded rods, wherein the axle comprises first and second receiving apertures, the first aperture holding a lower end of the first rod and the second aperture holding a lower end of the second rod.

18. The hospital bed of claim 17, wherein the mounting member has a length such that each opposing end is fixedly attached to a different long side of the base frame.

19. The hospital bed of claim 17, wherein the mounting member comprises a square tube with upwardly extending opposing arms and a laterally extending center section, the center section having the laterally spaced apart channels.

20. The hospital bed of claim 17, wherein the mounting member has a width that is greater than a width of the axle so that the arms of the mounting member reside outside an outer edge of an underlying wheel and extend upwardly above the axle.

* * * * *

UNITED STATES PATENT AND TRADEMARK OFFICE

CERTIFICATE OF CORRECTION

PATENT NO. : 8,327,479 B2
APPLICATION NO. : 13/309914
DATED : December 11, 2012
INVENTOR(S) : Wurdeman It is certified that error appears in the above-identified patent and that said Letters Patent is hereby corrected as shown below:

In the Claims:

Column 6, Claim 8, Lines 31 and 32:

Please correct "lift mechanism the and" to read -- lift mechanism and the --

Column 7, Claim 11, Line 15:

Please correct "of the axle" to read -- of the axle; --

Signed and Sealed this
Eleventh Day of June, 2013

Teresa Stanek Rea

Teresa Stanek Rea
*Acting Director of the United States Patent and Trademark Office*